US008002160B2

(12) United States Patent
Larkin et al.

(10) Patent No.: US 8,002,160 B2
(45) Date of Patent: Aug. 23, 2011

(54) COMBUSTION FASTENER

(75) Inventors: John Frederick Larkin, Monterey, CA (US); Brian Whitney Lamb, Menlo Park, CA (US); Edward John Cooper, LaFayette, CA (US)

(73) Assignee: Black & Decker Inc., Newark, DE (US)

( * ) Notice: Subject to any disclaimer, the term of this patent is extended or adjusted under 35 U.S.C. 154(b) by 1433 days.

(21) Appl. No.: 11/215,794

(22) Filed: Aug. 30, 2005

(65) Prior Publication Data

US 2006/0060628 A1 Mar. 23, 2006

Related U.S. Application Data

(60) Provisional application No. 60/605,479, filed on Aug. 30, 2004.

(51) Int. Cl.
*B25C 1/08* (2006.01)

(52) U.S. Cl. ..... 227/10; 227/9; 123/46 A

(58) Field of Classification Search ..... 227/10, 227/9; 123/46 A, 48 C, 48 D
See application file for complete search history.

(56) References Cited

U.S. PATENT DOCUMENTS

| | | | | |
|---|---|---|---|---|
| 124 | A | 2/1837 | Fairbanks | |
| 3,964,659 | A | 6/1976 | Eiben et al. | 227/8 |
| 3,967,771 | A | 7/1976 | Smith | 227/10 |
| 3,973,708 | A | 8/1976 | Scotoni | 227/10 |
| 3,981,424 | A | 9/1976 | Maier | 227/10 |
| 4,063,672 | A | 12/1977 | Jochum | 227/10 |
| 4,066,198 | A | 1/1978 | Jochum et al. | 227/8 |
| 4,066,199 | A | 1/1978 | Jochum et al. | 227/10 |
| 4,068,790 | A | 1/1978 | Osterle et al. | 227/8 |
| 4,189,080 | A | 2/1980 | Smith et al. | 227/8 |
| 4,222,443 | A | 9/1980 | Chromy | 173/116 |
| 4,290,493 | A | 9/1981 | Smith et al. | 173/124 |
| 4,365,471 | A | 12/1982 | Adams | 60/39.76 |

(Continued)

FOREIGN PATENT DOCUMENTS

EP 1 459 850 9/2004

OTHER PUBLICATIONS http://www.guden.com/gas_springs_1.1.asp.*

*Primary Examiner* — Rinaldi I Rada
*Assistant Examiner* — Gloria R Weeks
(74) *Attorney, Agent, or Firm* — Harness, Dickey & Pierce, P.L.C.

(57) ABSTRACT

A dual combustion fastener device implements a first combustion event, contained in a first combustion chamber portion to compress a combustible fuel/air mixture contained in a second combustion chamber portion, which is separated from the first combustion chamber portion by a piston including a driver for driving a fastener disposed in the driver's path of travel into a workpiece, in order to generally provide rapid driving power for securing a fastener disposed in a nose guide of the combustion fastener. Ignition of the second combustion event may be timed so that the second combustion event substantially occurs when the piston has achieved top dead center or the maximum compression of the combustible material in the second combustion chamber portion. Utilization of compressed combustible material may allow for the utilization of a piston having a small cross-sectional area in comparison to a typical combustion device while providing equal or greater driving force in a rapid manner.

43 Claims, 9 Drawing Sheets

U.S. PATENT DOCUMENTS 4,368,588 A 1/1983 Jochum et al. 42/1 R
4,382,533 A 5/1983 Buechel et al. 227/10
4,401,251 A 8/1983 Nikolich 227/130
4,403,722 A 9/1983 Nikolich 227/8
4,405,072 A 9/1983 Kindle et al. 227/10
4,406,079 A 9/1983 Buechel et al. 42/49 R
4,448,261 A 5/1984 Kousek et al. 173/12
4,483,280 A 11/1984 Nikolich 123/46 SC
4,483,474 A 11/1984 Nikolich 227/8
4,510,748 A 4/1985 Adams 60/39.02
4,522,162 A 6/1985 Nikolich 123/46.5 C
4,534,500 A 8/1985 Jochum 227/7
4,549,344 A 10/1985 Nikolich 29/432
4,577,793 A 3/1986 Jochum 227/10
4,611,738 A 9/1986 Jochum 227/9
4,640,452 A 2/1987 Matt et al. 227/131
4,665,868 A 5/1987 Adams 123/46 SC
RE32,452 E 7/1987 Nikolich 123/46 SC
4,712,379 A 12/1987 Adams et al. 60/632
4,717,060 A 1/1988 Cotta 227/10
4,721,240 A 1/1988 Cotta 227/10
4,739,915 A 4/1988 Cotta 227/10
4,759,318 A 7/1988 Adams 123/46.5 C
4,763,478 A * 8/1988 Liemert et al. 60/633
4,773,581 A 9/1988 Ohtsu et al. 227/10
4,883,212 A 11/1989 Philipp 227/9
4,913,331 A 4/1990 Utsumi et al. 227/10
4,942,996 A 7/1990 Wolfberg et al. 227/136
5,090,606 A 2/1992 Torii et al. 227/10
5,115,944 A 5/1992 Nikolich 222/94
5,133,329 A 7/1992 Rodseth et al. 123/630
5,181,495 A 1/1993 Gschwend et al. 123/46 SC
5,191,861 A 3/1993 Kellerman et al. 123/46 SC
5,197,646 A 3/1993 Nikolich 227/8
5,199,626 A 4/1993 Terayama et al. 227/10
5,201,449 A 4/1993 Miller 227/8
5,213,247 A 5/1993 Gschwend et al. 227/10
5,263,439 A 11/1993 Doherty et al. 123/46 SC
5,329,839 A 7/1994 Ehmig 89/1.14
5,365,917 A 11/1994 Adams et al. 123/491
5,377,628 A 1/1995 Adams 123/41.31
5,415,136 A 5/1995 Doherty et al. 123/46 SC
5,435,285 A 7/1995 Adams et al. 123/492
5,471,903 A 12/1995 Brede et al. 89/1.14
5,492,102 A 2/1996 Thomas et al. 123/493
5,520,162 A 5/1996 Rotramel et al. 123/689
5,540,194 A 7/1996 Adams 123/46 R
5,558,264 A 9/1996 Weinstein 227/10
5,592,580 A 1/1997 Doherty et al. 388/815
5,680,980 A 10/1997 Robinson 227/10
5,713,313 A 2/1998 Berry 123/46 SC
5,720,423 A 2/1998 Kondo et al. 227/130
5,722,578 A 3/1998 Van Erden et al. 227/8
5,799,855 A 9/1998 Veoukas et al. 227/10
5,806,747 A 9/1998 Van Erden et al. 227/10
5,860,580 A 1/1999 Velan et al. 227/10
5,873,508 A * 2/1999 MacVicar et al. 227/10
5,897,043 A 4/1999 Veoukas et al. 227/10
5,909,836 A 6/1999 Shkolnikov et al. 227/8
5,927,585 A 7/1999 Moorman et al. 227/132
5,971,245 A 10/1999 Robinson 227/10
5,975,397 A 11/1999 Van Erden et al. 227/10
5,975,569 A 11/1999 Starozhitsky et al. 280/741
6,006,704 A 12/1999 Phillips et al. 123/46 SC
6,016,946 A 1/2000 Phillips et al. 227/10
6,019,072 A 2/2000 Phillips et al. 123/46 H
6,041,603 A 3/2000 Phillips 60/632
6,045,024 A 4/2000 Phillips 227/130
6,102,270 A 8/2000 Robinson 227/10
6,108,908 A 8/2000 Starozhitsky et al. 29/897.2
6,109,165 A 8/2000 Velan et al. 92/23
6,116,489 A 9/2000 Branston 227/10
6,126,055 A 10/2000 Gantner et al. 227/10
6,145,724 A 11/2000 Shkolnikov et al. 227/8
6,158,643 A 12/2000 Phillips 227/130
6,164,510 A 12/2000 Deieso et al. 227/130
6,257,476 B1 7/2001 Ehmig 227/10
6,260,519 B1 7/2001 Phillips 123/46 R
6,283,102 B1 9/2001 Nelson et al. 123/575
6,289,789 B1 9/2001 Heeb et al. 92/169.1
6,321,968 B1 11/2001 Remerowski 227/10
6,378,288 B1 4/2002 Towfighi et al. 60/39.6
6,425,354 B1 7/2002 Buchel et al. 123/46 R
6,431,426 B1 8/2002 Ehmig 227/10
6,443,118 B2 9/2002 Thieleke et al. 123/268
6,460,507 B2 10/2002 Thieleke et al. 123/260
6,463,894 B2 10/2002 Hasler et al. 123/46 R
6,481,608 B2 11/2002 Wohlwend et al. 227/9
6,488,455 B1 12/2002 Staebler et al. 409/182
6,491,002 B1 12/2002 Adams 123/46 R
6,491,015 B1 12/2002 Thieleke et al. 123/260
6,491,199 B2 12/2002 Wohlwend et al. 227/10
6,520,127 B1 2/2003 Thieleke et al. 123/46 R
6,520,397 B1 2/2003 Moeller 227/130
6,523,860 B1 2/2003 Shkolnikov et al. 285/3
6,526,926 B1 3/2003 Towfighi 123/46 R
6,532,917 B2 3/2003 Thieleke et al. 123/46 SC
6,584,945 B2 7/2003 Porth 123/169 EL
6,607,111 B2 8/2003 Garvis et al. 227/131
6,619,527 B1 9/2003 Moeller 227/10
6,626,344 B2 9/2003 Shkolnikov et al. 227/10
6,634,325 B1 10/2003 Adams 123/46 R
6,647,969 B1 11/2003 Adams 123/527
6,655,570 B2 12/2003 Shkolnikov et al. 227/10
6,666,366 B2 12/2003 Rosenbaum et al. 227/8
6,669,072 B2 12/2003 Burke et al. 227/131
6,671,163 B2 12/2003 Shkolnikow et al. 361/253
6,679,410 B2 1/2004 Wursch et al. 227/2
6,755,335 B2 * 6/2004 Fielitz 227/10
6,796,478 B2 9/2004 Shkolnikov et al. 227/10
6,874,452 B2 * 4/2005 Adams 123/46 R
2001/0009260 A1 7/2001 Ishizawa et al. 227/8
2001/0048016 A1 12/2001 Akiba 227/8
2001/0054281 A1 12/2001 Adams et al. 60/276
2002/0027150 A1 3/2002 Hamada et al. 227/119
2002/0046847 A1 4/2002 Ichijyou et al. 173/48
2002/0060233 A1 5/2002 Akiba 227/109
2002/0108986 A1 8/2002 Akiba 227/8
2002/0134069 A1 9/2002 Adams 60/39.6
2002/0134345 A1 9/2002 Adams 123/285
2002/0134811 A1 9/2002 Napier et al. 227/131
2002/0144498 A1 10/2002 Adams 60/39.6
2002/0195070 A1 12/2002 Adams 123/46 R
2003/0006050 A1 1/2003 Shinohara 173/4
2003/0010510 A1 1/2003 Kamo et al. 173/4
2003/0052152 A1 3/2003 Hamada 227/120
2003/0080171 A1 5/2003 Sato et al. 227/119
2003/0080172 A1 5/2003 Hirai 227/142
2003/0094292 A1 5/2003 Haga 173/48
2003/0110758 A1 6/2003 Adams 60/39.6
2003/0131809 A1 7/2003 Adams 123/46 R
2003/0146262 A1 8/2003 Hwang et al. 227/113
2003/0155142 A1 8/2003 Kikuchi et al. 173/114
2003/0159843 A1 8/2003 Sakai et al. 173/216
2003/0230620 A1 * 12/2003 Fielitz 227/10
2004/0011846 A1 1/2004 Aoki et al. 227/130
2004/0238588 A1 * 12/2004 Oda et al. 227/10

* cited by examiner

COMBUSTION FASTENER

CROSS REFERENCE

The present application claims priority under 35 U.S.C. §119(e) to U.S. Provisional Patent Application Ser. No. 60/605,479, entitled: Combustion Fastener, filed on Aug. 30, 2004, which is hereby incorporated by reference in its entirety.

FIELD OF THE INVENTION

The present invention relates to the field of fasteners and particularly to a combustion fastener, such as a combustion nailer.

BACKGROUND OF THE INVENTION

Combustion fasteners offer increased portability over pneumatic fasteners. Combustion fasteners are particularly useful in situations in which the user does not wish to transport a compressor/pneumatic hose for providing compressed air to the pneumatic fastener. For instance, a pneumatic hose may be troublesome in situations in which the pneumatic fastener device or nailer is often repositioned due to the attached pneumatic hose. While combustion fasteners provide portability, the overall dimensions of the combustion device may make utilization awkward due the various components required for operation/the configuration of the device. Additionally, current devices implement combustion events which are ignited at environmental pressure (i.e., standard pressure). Moreover, typical component arrangement may prevent scalability of the design over a range of combustion devices. For example, some typical combustion fastener designs are not suitable, due to their overall size, for implementation with smaller frame fasteners such as brad nailers, finish nailers, or the like due to the size of the included components when compared to a pneumatically operated device. Furthermore, such devices may generate more noise during operation (often due to the inclusion of a reed valve) which may detract from utilization in environment in which small frame fasteners are utilized.

In some instances, even framing combustion fasteners, such as may be utilized when framing a building or for other rough construction, may not be suitable for various tasks. When framing, often the fastening device may have to fit into a limited space such as between two adjoining joists where one of the joists is doubled up with a third joist, for sufficient rigidity and strength, or the like confined area. In other instances, a fastener device may have to be angled to permit toe nailing of a fastener (i.e., drive a nail at an angle other than generally ninety degrees). Typical tasks in-which the size of the device may become an issue include toe nailing rafters and joists, attaching joist hangers, constructing complex roof valley systems, and the like. For instance, typical combustion fasteners require a piston with a large cross-sectional area to generate sufficient kinetic energy to drive a selected fastener. Additionally, typical devices also generate kickback on the handle due to the momentum of the piston.

The size of current combustion fasteners generally may be attributed to need to generate sufficient kinetic energy in a rapid manner to drive the selected fasteners (i.e., nails, staples) as well as the size of a reservoir required for containing fuel. As a result, the piston is usually disposed adjacent the end of the chamber which is opposite the nose (the end of the combustion fastener from which the fasteners are expelled). As the combustion event occurs, the piston is driven toward the nose of the fastener device so as to contact the nail disposed in the path of a blade included in the piston. The piston is then subsequently returned to the end opposite the nose, so the combustion fastener may be reutilized. As a result, the overall dimensions of the combustion fastener may be of a larger size compared to a pneumatically operated device for the same general purpose.

Combustion fastener maintenance may be troublesome as some combustion fasteners may require frequent maintenance (in comparison to a pneumatically operated device) due to fouling, the stresses imposed on various components such as a fan disposed in a combustion chamber. Fouling may require invasive cleaning which necessitates the fastener device be removed from service for an extended amount of time. Inclusion of a fan contained within the chamber in which combustion occurs may necessitate the selection of a device having robust characteristics to ensure proper operation, and sufficient utilization intervals between maintenance, as well as, increasing expense.

Therefore, it would be desirable to provide a combustion fastener constructed to implement two combustion events for providing increased driving capability while decreasing the size of the device over typical devices.

SUMMARY OF THE INVENTION

Accordingly, the present invention is directed to a combustion fastener device providing increased functionality and decreased size over current combustion devices while minimizing or preventing drawbacks previously experienced.

In an aspect of the present invention, a dual combustion fastener device implements a first combustion event, contained in a first combustion chamber portion to compress a combustible fuel/air mixture contained in a second combustion chamber portion, which is separated from the first combustion chamber portion by a piston including a driver for driving a fastener disposed in the driver's path of travel into a workpiece, in order to generally provide rapid driving power for securing a fastener disposed in a nose guide of the combustion fastener. Ignition of the second combustion event may be timed so that the second combustion event substantially occurs when the piston has achieved top dead center or the maximum compression of the combustible material in the second combustion chamber portion. Utilization of compressed combustible material may allow for the utilization of a piston having a small cross-sectional area in comparison to a typical combustion device while providing equal or greater driving force in a rapid manner.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. The present invention is directed to a two event combustion fastener device providing increased functionality and decreased size over current combustion devices. For example, a combustion fastener in accordance with an embodiment of the present invention may have an overall shorter main body portion while having increased driving performance over current devices. Additionally, a device in accordance with the present invention may allow for a common construction scheme so as to allow scaling to accommodate different sized fastener devices, e.g., a framing nailer, a brad nailer, a finish nailer, and the like. Those of skill in the art will appreciate that while the present invention is primarily directed to a device configured to implement two combustion events many of the principles of the present invention may be implemented in the improvement of current combustion devices. Moreover, while the present invention is illustrated with a stick type magazine for retaining fasteners to be secured other suitable storage systems may be utilized including coil type magazines primarily utilized in the securing of roofing nails (i.e, nails having a large head in comparison to the shank of the nail). Of further note, while nail type fasteners are referenced for illustrative purposes, a device in accordance with the present invention may secure a variety of fasteners, such as staples, pins, nails having caps usually formed of plastic for retaining building wrapping material or felt paper, and the like. It is the intention of the present disclosure to encompass and include such variation.

Figure 1:
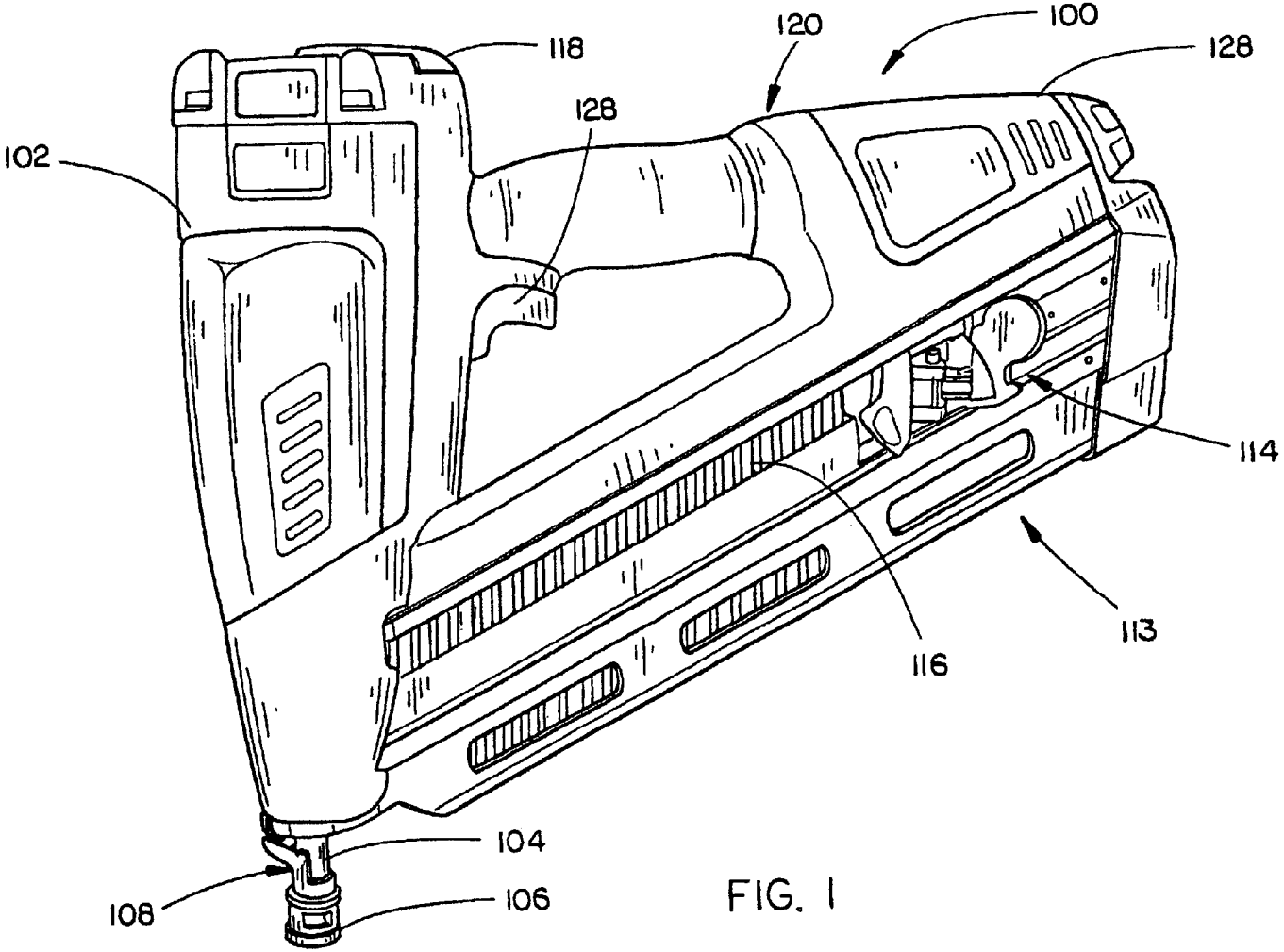
FIG. 1 is an isometric view of a combustion fastener in accordance with an aspect of the invention.

Referring to FIG. 1, in the present embodiment of the invention, a dual combustion event fastener device 100 is disclosed. The combustion fastener 100 includes a main housing 102 for housing combustion assembly components and the like. A nose guide 104 extends generally from an end of the main housing 102. The nose guide 104 defines a channel through which fasteners are driven into a workpiece. A contact safety 106 coupled at least partially around or adjacent to the end of the nose guide. The contact safety is configured to slide towards/away from the nose guide 104. Linkages 108 are coupled to the contact safety for preventing or allowing actuation of the combustion fastener device 100 depending on the position of the contact safety with respect to the nose guide 104.

For example, the linkages 108 may be configured to physically block combustion fastener 100 operation such as by blocking fuel injection, and the like. In further examples, the linkage may be physically coupled to an electrical interlock switch 110 which is electrically coupled to an electronic control system for controlling various combustion fastener device 100 functions such as fan operation, fuel injection, ignition, and the like. Additionally, the contact safety and corresponding linkages may be utilized to manipulate combustion fastener components with respect to the main housing/fixed components within the combustion fastener 100. For instance, a sleeve 112, included in the combustion assembly 132, may be coupled to the contact safety linkages 108 so as to slidingly adjust based on movement of the contact safety 106/linkages 108. In the present embodiment, the sleeve may generally function as a valve for controlling the flow of fluid/gasses. In further embodiments, an adjustment device such as a threaded intermediate knob or nut coupled to a threaded rod portion included in a linkage may be implemented to extend the overall length of the contact safety and linkage system thereby adjusting the extent to which the contact safety extends along or away from the nose guide of the combustion fastener. Preferably, the contact safety 106 is biased by a spring into an extended position wherein the contact safety is extended to its furthest remote position along the nose of the device and is depressed inwards toward the main housing by a user contacting the nose guide with a workpiece.

A magazine constructed to contain fasteners to be driven is included in the combustion fastener device. For example, a stick or linear magazine 113 for retaining nails arranged in a strip is included. In additional embodiments, coil magazines and the like systems for holding fasteners to be secured may be implemented. The magazine 113 and the channel included in the nose guide are arranged to dispose a fastener (such as a nail) into the nose guide 104 channel in the path of travel of a driver blade in order for the driver blade to expel the fastener into a workpiece. The magazine 113 may include a forwarding device or multiple forwarding devices for generally directing the fasteners 116 towards the nose guide. For example, a spring biased pusher 114 may be implemented to assist in forwarding the contained fasteners towards the nose guide 104. For example, a pusher 114 may include a coil spring and a pawl, for engaging with at least one of the fasteners 116. As will be discussed with respect to FIG. 7, a pneumatically operated forwarding device such as a nailfeed, may be utilized to provide sufficiently rapid fastener forwarding in an embodiment.

Figure 8A:
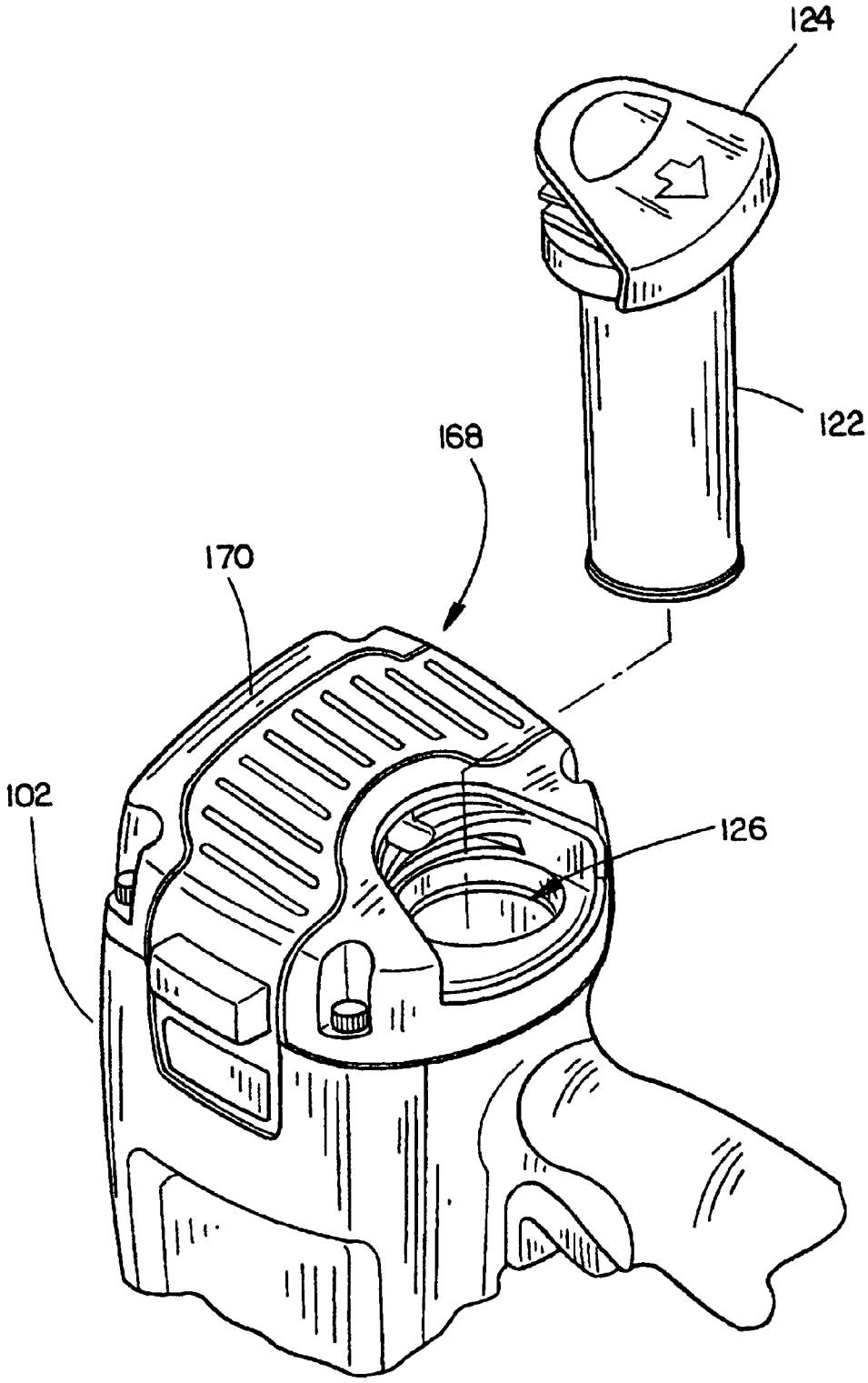
FIG. 8A is an exploded view of the integration of a removable fuel canister into a combustion fastener of the present invention.
Figure 8B:
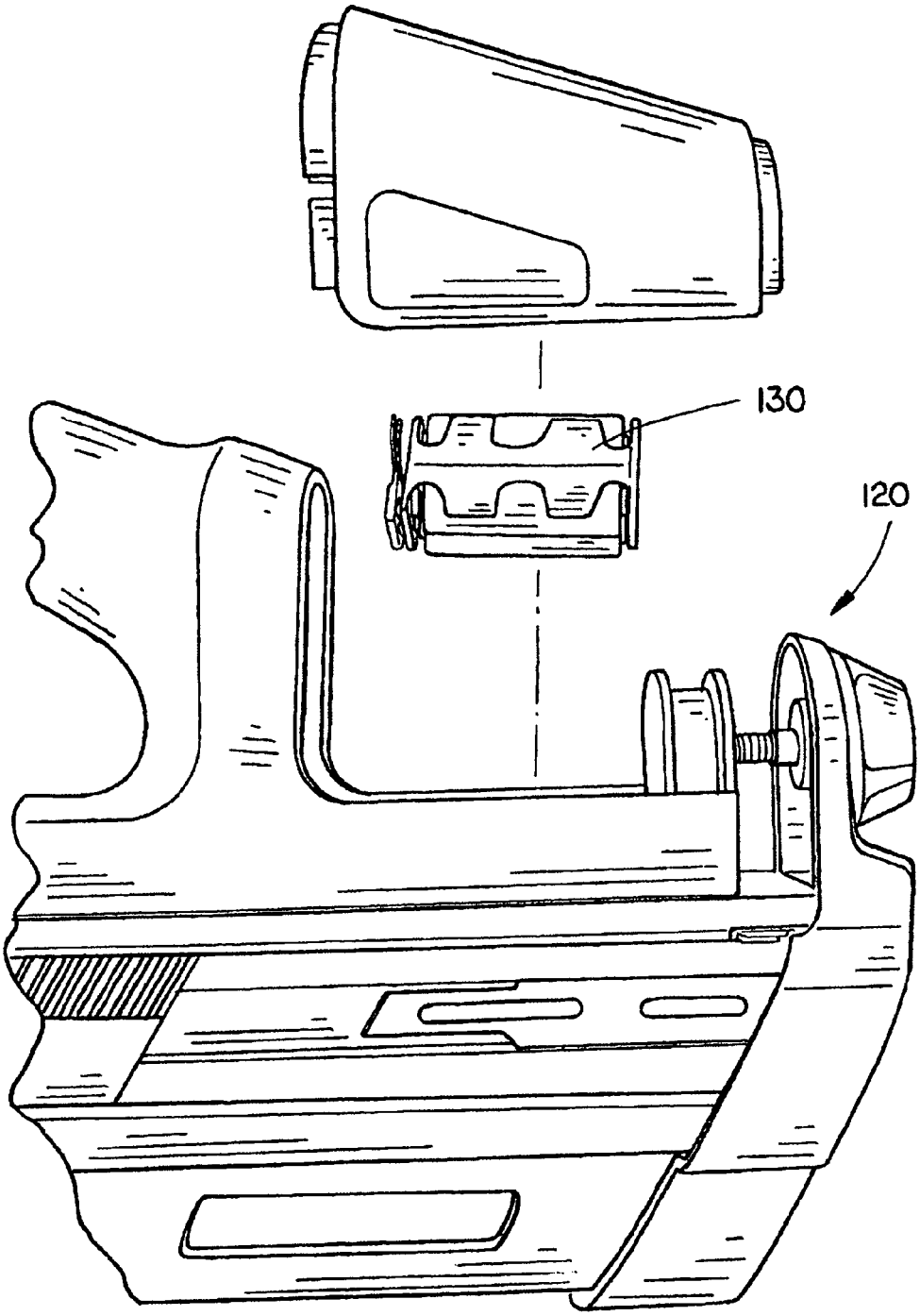
FIG. 8B is an exploded view of a rechargeable battery assembly for utilization in providing electrical energy to a combustion fastener of the present invention.

With continued reference to FIG. 1, a closure cap may be included for enclosing a recesses one of the main housing 102 or a handle 120 for retaining removable components such as a replaceable fuel cartridge, for storing fuel for operating the combustion fastener, a battery, for providing electrical energy to various electronic controls, blowers, fans, and the like. In further instances, a recess may be included for at least partially receiving the component. Referring to FIG. 8B or instance, a rechargeable battery 130 may be partially or entirely received in the handle to permit electrical coupling between contacts included in the recess and corresponding contacts on a removable battery. Suitable closure caps include sliding enclosures, screw caps and the like. Referring briefly to FIG. 8A, in the present example, a generally cylindrical fuel cartridge 122 having a quick connection and valve may be received in a main housing recess 126 in order for the connection to permit fluid connection between the cartridge and a fuel metering system such as a shuttle valve system. An example of a fuel cartridge system is disclosed in U.S. Pat. No. 6,796,478 entitled: Fuel Cell Adapter System for Combustion Tools, which is hereby incorporated by reference in its entirety. A sliding enclosure 124 may be implemented to secure the fuel cartridge in the recess/ensure proper connection, as well as, preventing the ingress of dust and debris. Suitable fuel metering systems include those described in U.S. Pat. Nos. 6,006,704 and 6,016,946, entitled, respectively, Internal Combustion Fastener Driving Tool Fuel Metering System and Internal Combustion Fastener Driving Tool Shuttle Valve, both of which are hereby incorporated by reference in their entireties.

Referring to FIG. 1, a trigger 128 is mounted to at least one of the main housing 102 or the handle 120. In the present embodiment, the trigger is an enclosed trigger (having sides) for preventing the ingress of dust and debris to an electrical switch, operatively disposed or coupled with the trigger, for initiating ignition, fan operation, or the like.

Figure 2:
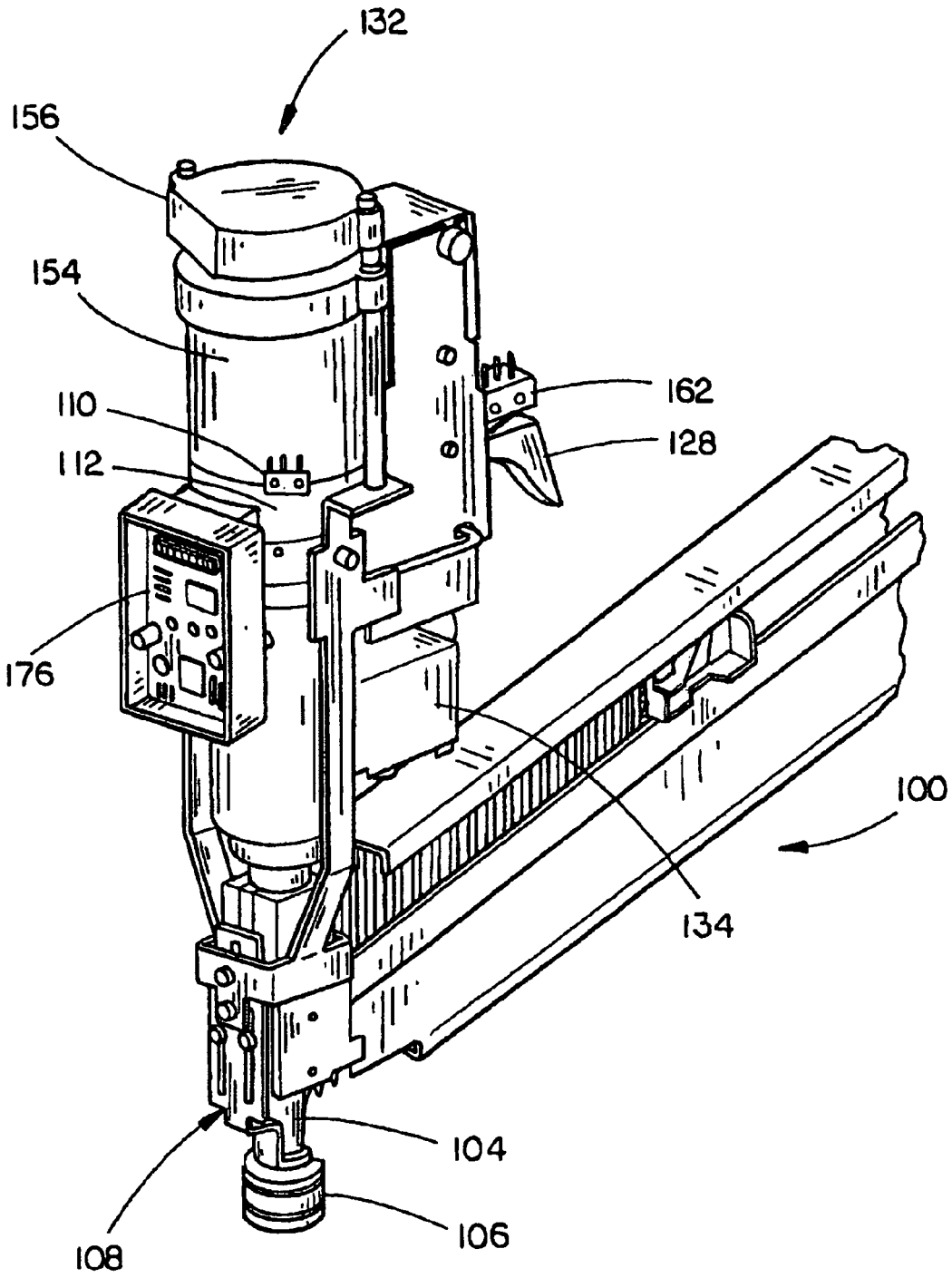
FIG. 2 is an isometric view of a combustion assembly for implementation with a combustion fastener in accordance with the present invention.
Figure 3:
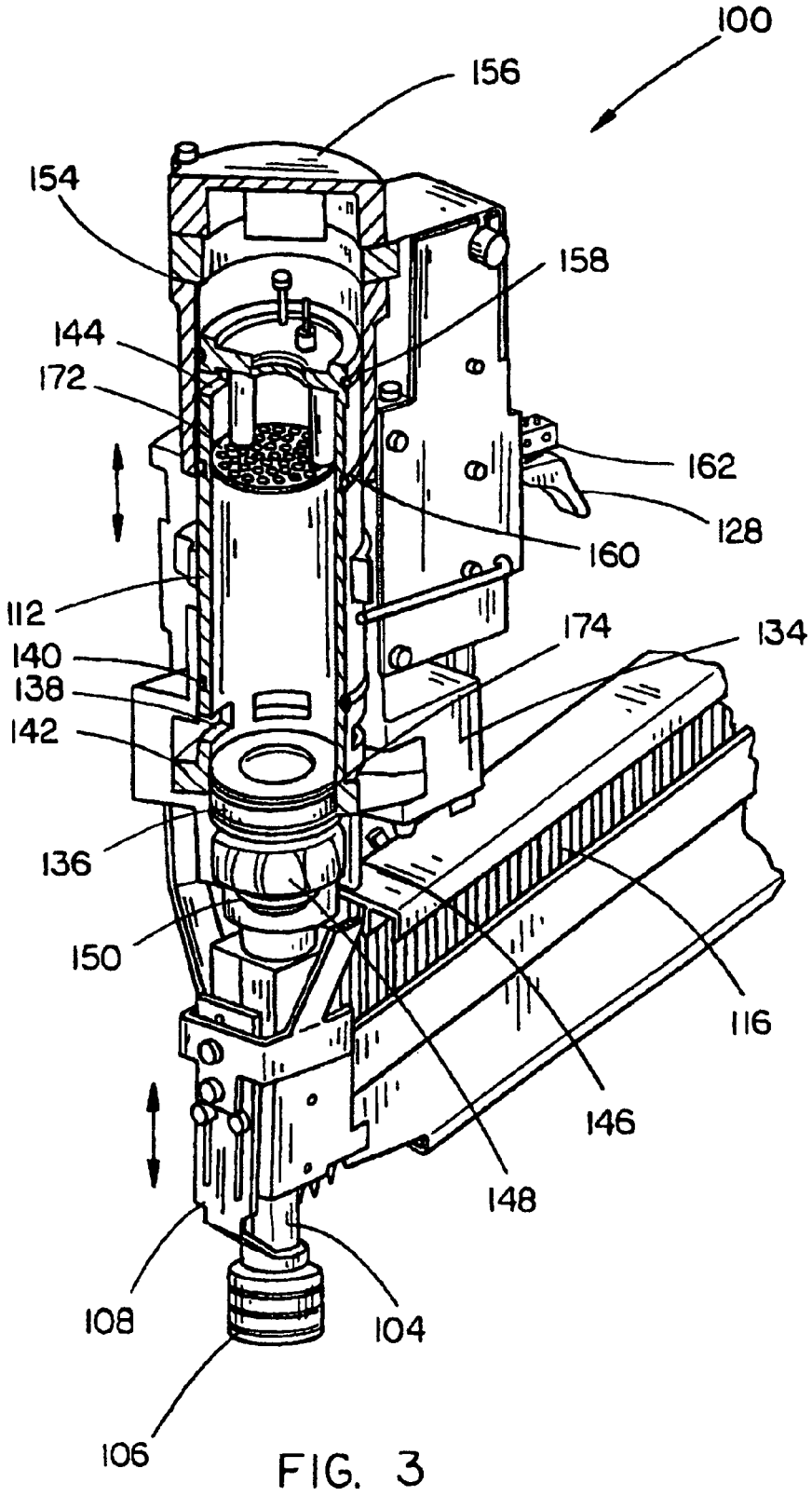
FIG. 3 is a partial cut away view of a combustion assembly for implementation with a combustion fastener in accordance with the present invention wherein the sleeve and piston are disposed substantially adjacent the nose guide.

With reference to FIGS. 2 and 3, a combustion assembly 132 included in the combustion fastener device 100 in accordance with an embodiment is described. Those of skill in the art will appreciate that while the present invention implements discrete components (e.g., a first chamber portion and a second chamber portion) the principles of the present invention are equally applicable to a device in which the chamber portions included in a combustion chamber are substantially unitary with appropriate porting, valves, flow lines or tubing, and the like for permitting transfer of gases.

Those of skill in the art will additionally appreciate that in a unitary cylinder combustion chamber system and the combustion assembly 132 of the present embodiment, the volumetric capacity of chamber portions (e.g., the first chamber portion the second chamber portion, and the sleeve) vary. In the present instance, the volume of the first combustion chamber and the portion of the sleeve 112 towards the nose guide varies as the movement of the piston 136 and the sleeve 112 adjusts with respect to the chamber portions, due to sliding movement of the contact safety and linkages. For example, the extent to which the sleeve 112 and piston are extended into the first chamber portion 134 as may be best observed in FIGS. 3 though 5. Additionally, while a system in which a sliding, adjustable sleeve is received in the housing is referenced, a system in which components including partial enclosures, fans, fuel injectors are adjusted while a central chamber remains fixed is also contemplated.

In the present embodiment, the combustion assembly 132 includes a first combustion chamber portion 134 which includes an interior recess which is configured to receive a sleeve 112 having through apertures or ports for permitting fluid coupling between the interior of the sleeve and the interior of the first chamber portion 134. In a preferred example, the interior recess of the first combustion chamber portion includes a portion having a greater cross-sectional area than the sleeve central opening/the head portion of the piston. In the foregoing instance, configuring a first chamber portion having a larger interior recess may permit the inclusion of a flange 142 on the sleeve 112 to aid in alignment/movement of the sleeve with regards to the first combustion chamber portion. Additionally, a first combustion chamber portion having a larger cross-sectional area than the sleeve piston may allow for the escape of gasses, generated by a first combustion event, from the first chamber portion to prevent the gasses from dampening or resisting the movement of the piston as the piston travels to contact the fastener. The current configuration may allow for fluid communication between the combustion chamber components to allow for exhausting of waste gasses from the first chamber portion, the second chamber portion, and the sleeve. For example, the sleeve may be formed as a tube having a closed end generally away from the first chamber portion. A series of ports 138 (one is referenced) may be formed in the sleeve adjacent first chamber portion 134 to allow for fluid communication between the interior of the first chamber portion 134 and the interior of the sleeve depending on the position of the sleeve 112 relative to the first chamber portion 134. For example, the ports 138 included in the sleeve may be blocked by an outward extending flange included in the first chamber portion depending on the position of the contact safety 106 with respect to the nose guide 104 of the combustion fastener device 100. The ports 138 may additionally allow for a fuel injector or sprayer to spray fuel into the sleeve/a second combustion chamber for fueling a second combustion event which occurs on the side of the piston opposite a driver blade 152 (FIG. 4) for driving fasteners. Passage of gasses around the sleeve may be prevented/minimized by the inclusion of an O-ring 140 disposed in a groove formed in the outer surface of the sleeve 112. The O-ring 140 being disposed further away from an open end of the sleeve than the ports 138 in order to seal the sleeve and the first combustion chamber. Additionally, in the present example, the piston 136 includes a first O-ring and a second O-ring, each being retained at least partially in grooves formed in the head of the piston 136, for aiding in alignment of the piston, and for preventing the passage of gasses around the head of the piston 136.

Additionally, the first chamber portion 134 may include a concentric extension directed 146 towards the nose guide 104 in order to form a cup to allow extension of the piston 136 towards the nose. A bumper 148 formed of deformable material may be included for preventing damage to the piston/prevent the piston from bottoming out against the first chamber portion 134/the nose guide 104. Additionally, a seal or O-ring 1150 may be disposed on the bumper 148 adjacent the nose guide to prevent the escape of gasses through the nose. Preferably, the bumper 148 includes a through aperture for allowing a driver blade 152 (as may be observed in FIG. 4) included in the piston for driving a fastener disposed in the path of the driver blade 152 in the nose guide. Those of skill in the art will appreciate the seal or O-ring may include an insert for accommodating a driver blade which is semicircular, which is utilized for driving clipped head or semi-circular headed nails.

In the present embodiment, a second combustion chamber portion 154 is formed generally as a cap having an interior recess for receiving at least a portion of the sleeve 112. The combustion chamber may include a passage or aperture for allowing fluid communication with a fan 156 such as a centripetal fan disposed exterior to the combustion chamber/combustion chamber portions. In this fashion, the fan or impeller may have limited exposure to vibrations and combustion residues formed during combustion events. In the current embodiment, the fan 156 is configured to exhaust waste gasses/draw air via venting 168 in an end cap 170 included in the main housing 102 (FIG. 8A) included generally at the rear of the combustion fastener.

The fan 152 may be isolated from the interior of the second combustion chamber portion 154/the sleeve 112 during combustion by a shuttle valve, or the like. In the present embodiment, fluid communication between the second combustion chamber portion 154/the sleeve 112 and the fan 156 may be prevented or enabled by the position of the sleeve (and a sleeve ports 144 (one is referenced) disposed adjacent the end of the sleeve 112 received in the second combustion chamber portion) with respect to the interior of the second chamber portion. In the foregoing manner, fluid communication between the fan and the second combustion chamber/the sleeve may be prevented when the sleeve is aligned with the wall of the second chamber portion 154. Fluid communication may be permitted when the sleeve ports 144 are aligned with an enlarged portion of the interior recess, a passage, or the like for providing fluid communication. Enabling fluid communication may permit exhausting of waste gasses and/or the mixing of air and fuel from the second combustion chamber portion, the sleeve, the first combustion chamber portion, or a combination thereof. In further embodiments, a separate air tube or passage may be included for coupling the fan 156 and the first combustion chamber portion. The passage may be isolated by a valve. A first O-ring 158 and a second O-ring 160 may be included in grooves on the exterior surface of the sleeve such that the ports 144 are disposed between O-rings 158 and 160.

With reference to FIGS. 2 and 3, an ignition assembly is included in the combustion fastener 100. The ignition assembly may be integrated into an electronic control system which is integrated as part of a printed circuit board 176 for controlling electronics included in the combustion fastener 100. The ignition assembly is coupled to an electrical switch 162 configured to be actuated by a trigger 128. The ignition assembly may permit ignition of a first combustion event occurring in the first combustion chamber 134 by a first ignition source 164 (or multiple sources as contemplated by one of ordinary skill in the art) and a subsequent ignition of a second combustion event in the second combustion chamber portion 154/sleeve 112 subsequent to the occurrence of the first combustion event. For example, the second combustion triggered by a second ignition source 166 (or multiple sources as contemplated by one of ordinary skill in the art) event may be timed to occur when the piston has substantially reached its maximum extension towards the second combustion chamber (top dead center or the point at which the pistons momentum is substantially neutral) or the piston's maximum extension away from the nose guide 104. Those of skill in the art will appreciate that ignition may be configured to lead the combustion event. For example, the combustion fastener device 100 is configured to ignite the second combustion event by approximately 2 ms (two milliseconds). In further embodiments, other methodologies may be implemented to trigger the second combustion event. Other systems include pressure trigger systems, movable electrical contacts, and the like. In the foregoing instance, the pressure of fuel/air, or combustion material, within the second combustion chamber portion and the sleeve (bounded by the piston head) may be at its substantially maximum pressure at ignition. Multiple ignition sources may be preferable for generating increased pressure and turbulence. Suitable ignition devices include sparkplug type devices, Tesla coil type devices, and the like. In embodiments, an ignition source disposed on an end wall of the sleeve may be coupled to the ignition assembly via wiring or via an electrical contact which is directed toward a contact included on the second chamber portion wherein the contacts are in electrical connection when the sleeve has traveled sufficiently towards the second combustion chamber.

A burn screen 172, or plate perforated with through apertures, may be included for increasing the turbulence and correspondingly the power of the combustion event. In the present invention, the burn screen is mounted in the sleeve between the ignition source and the piston head. In further embodiments, the screen may be mounted to the piston head in a spaced apart relationship. In an embodiment, the bum screen 172 has approximately a 30% (thirty percent) open area. With apertures having a sufficiently narrow opening to permit through apertures being disposed across the substantial entirety of the bum screen. For example, the screen includes openings having 0.066" (sixty-six hundredths of an inch) diameter apertures. A burn screen having this level of perforation may provide for increased turbulence and provide for efficient combustion of the combustible material between the screen and the piston head thus, increasing the overall pressure achieved by the second combustion event utilized to drive the driver blade into contact with the fastener. Additionally, the screen may be positioned substantially adjacent the piston's top dead center.

In additional embodiments, one of the sleeve 112 or the second combustion chamber 154 may be formed with a cup-type projection or a central enclosed projection which extends towards the piston, wherein the piston includes a corresponding structure. Correspondingly, the piston may include a central projection to be received by the cup-type projection. In the forgoing manner, the ignition source may be disposed in the interior recess of the cup so that the flames are ejected through apertures in the side of the cup like projection into remaining portion of the sleeve/second combustion chamber to ignite the remaining combustible material.

Figure 4:
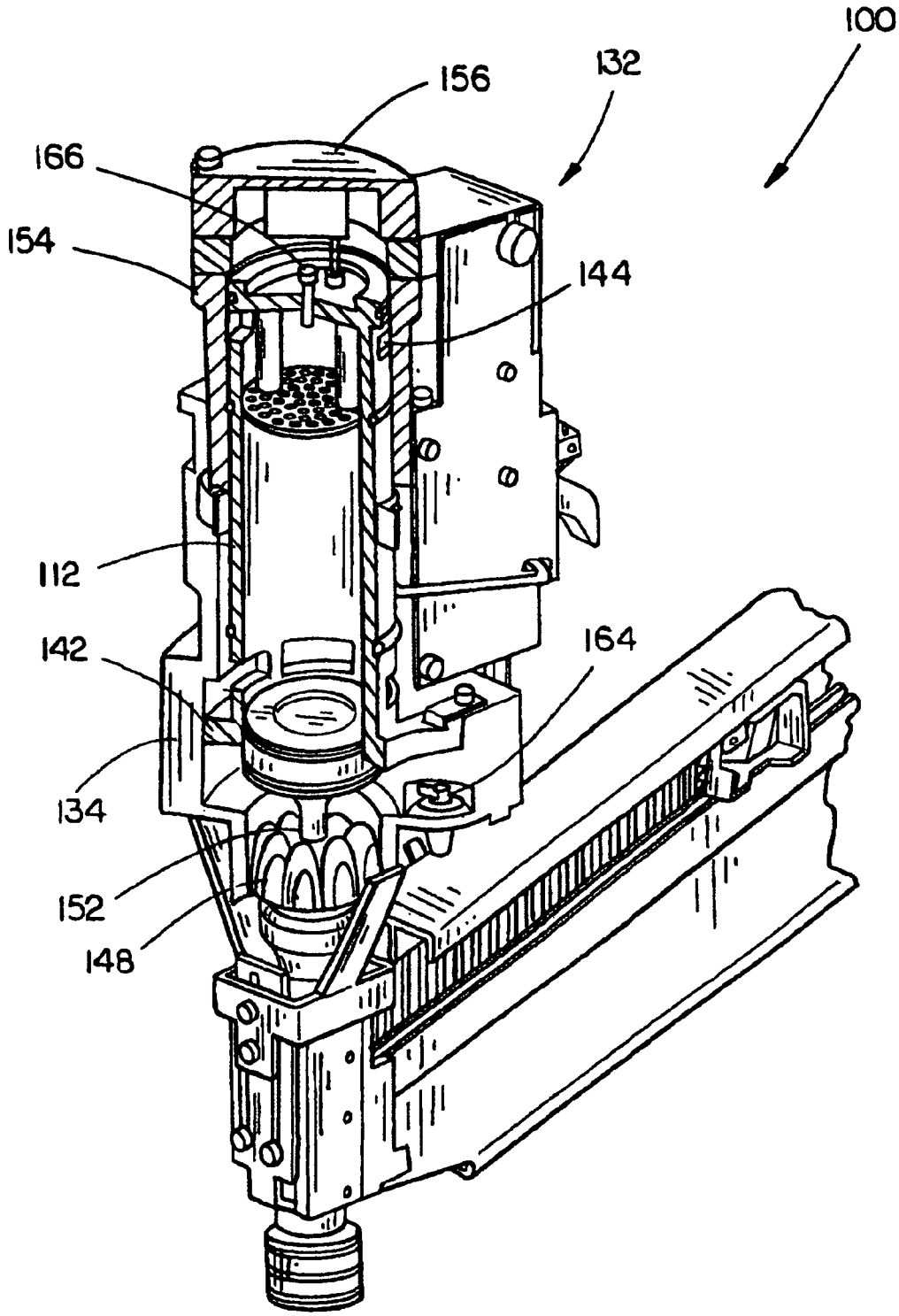
FIG. 4 is a partial cut away view of a combustion assembly for implementation with a combustion fastener in accordance with the present invention wherein the piston is disposed in a caught position and the sleeve is disposed adjacent the nose guide.
Figure 5:
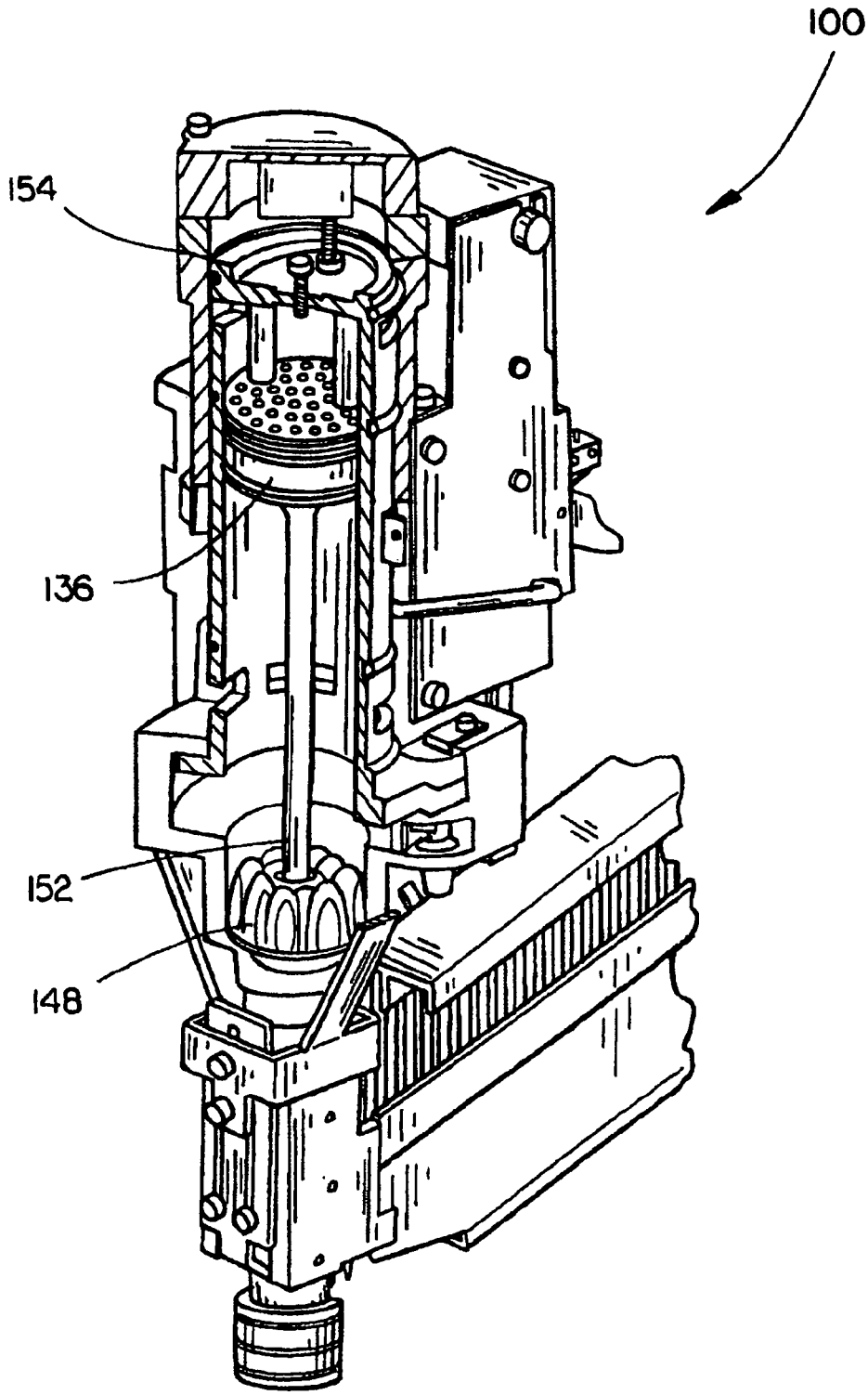
FIG. 5 is a partial cut away view of a combustion assembly for implementation with a combustion fastener in accordance with the present invention wherein the sleeve is extended towards a second combustion chamber and the piston is located generally at top dead center.

Referring now to FIGS. 3 through 5, an exemplary combustion fastener implementing a dual combustion event system is discussed. Additional, an exemplary method of operating a combustion fastener utilizing two combustion events is discussed. With particular reference to FIG. 3, in an initial state the piston 136 is disposed such that the driver blade 152 (best observed in FIG. 4) is positioned substantially in the nose guide 104. In this position, the driver blade is disposed generally in the path of the fasteners 116 to be forwarded into the nose guide 104. Additionally, the sleeve 112 may be disposed substantially adjacent the nose guide 104 so the first combustion chamber portion has effectively "collapsed" to allow for refreshing the first chamber portion with air (after a preceding combustion sequence). Disposing the piston in this fashion may reduce the overall size necessary for the combustion device (e.g., a smaller diameter piston and a smaller second combustion chamber (due to compression of the combustion material) over a typical device in-which the piston is disposed away from the nose of the device and the fastener is pre-aligned with the securing mechanism. In the previous instance, the combustion fastener of the present embodiment, while having decreased size, may generate driving power equal to or greater than current devices.

If a previous fastener was driven, the piston may have previously bounced or retracted slightly away from the nose guide 104 as the piston has bottomed out and returned to a "caught" position in-which an O-ring 174 included on the head of the piston is captured in a groove formed in the interior recess of the sleeve 112. (Two O-rings are illustrated for additionally preventing the passage of gasses around the piston head.) For example, in a previous sequence the piston may have bottomed out and been directed into the caught position by the bumper 148. In this initial position, the sleeve 112 and sleeve flange 142 are positioned generally adjacent the nose guide by operation of the contact safety (e.g., the safety is extended away from the nose guide). In the current embodiment, the sleeve ports 138 are positioned with respect to the first chamber portion to allow for the exhausting of waste gasses via fan 156 and providing air to the chambers.

Referring to FIG. 4, upon depression of the contact safety 106 towards the nose guide 104 the sleeve 112 may be slid towards the second combustion chamber portion so the sleeve 112 and second chamber portion 154 are in fluid communication, while the first chamber portion 134 is isolated. Additionally, the configuration of the first combustion chamber portion may provide a closing force for directing the sleeve 112 toward the second combustion chamber, thus aiding in isolating the first combustion chamber.

Figure 6:
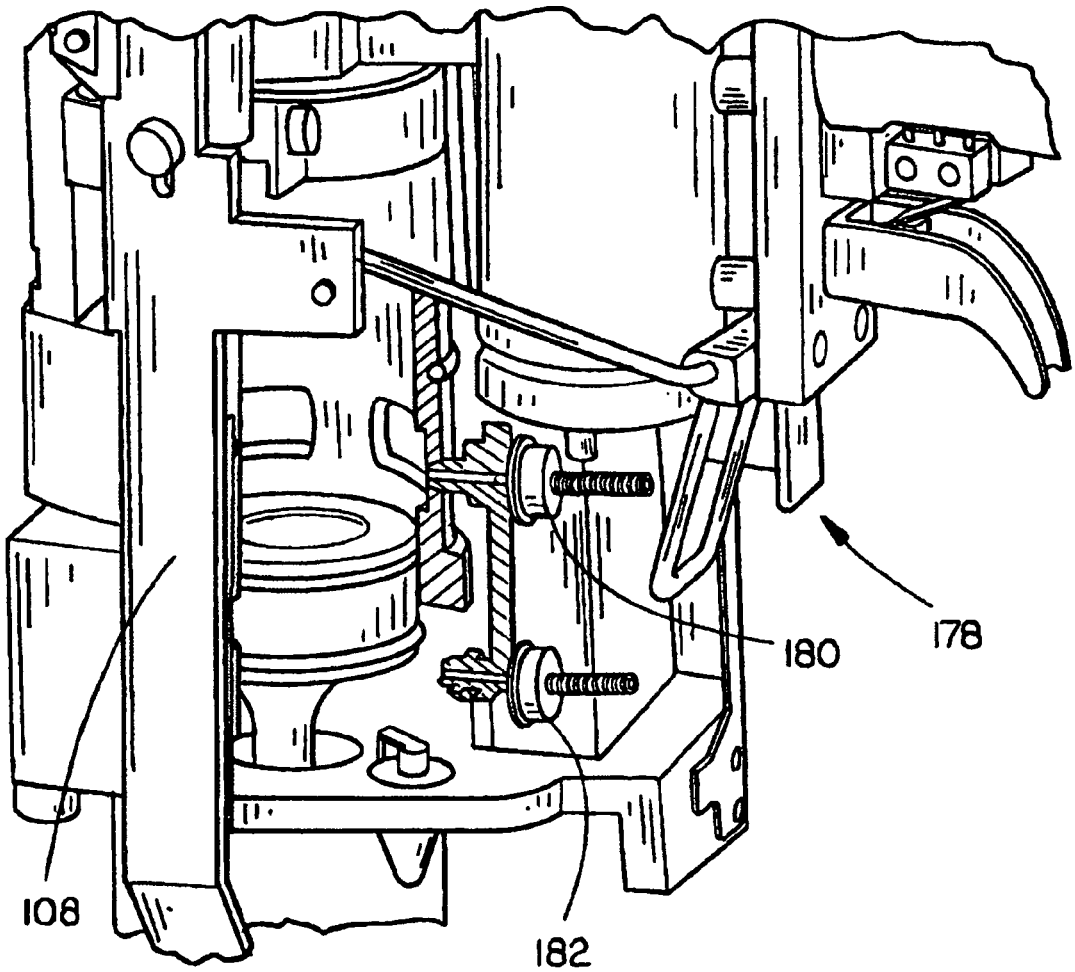
FIG. 6 is cut away illustration of a fuel metering system in accordance with an embodiment of the present invention.

Referring briefly to FIG. 6, fuel may be injected into, respectively, the first combustion chamber portion 134 and the second combustion chamber portion 154/the sleeve 112 by the fuel metering system 176. Actuation of the fuel metering system may be mechanically controlled based on manipulation of the contact safety linkages. A shuttle valve or the like may be included in the metering system 178 to provide the desired amount of fuel for the first and second combustion events. Fuel may be sprayed by a spring biased valve or nozzle, (nozzle 180 spraying into the sleeve 112 and second combustion chamber portion 154 while another spring biased valve or nozzle 182 sprays into the first combustion chamber portion). In the foregoing instances, fuel may be sprayed in an indirect manner (e.g. sprayed on a driver blade or toward a component other than the ignition source) so the spray will deflect and aid in fuel air mixing. In further instances, the fuel may be directed towards the ignition source, while providing sufficient mix without having to accommodate additional time required for fuel diffusion. Those of skill in the art will appreciate a wide variety of fuels and/or fuel combinations may be utilized. In additional examples, additives such as lubricants, anti-fouling agents and the like may be included in the fuel. In an additional example, a user adjustable controller may be utilized to allow a user to manually adjust the amount of fuel to be implemented in a combustion sequence to control the amount of energy/pressure generated by the combustion event sequence and in-particular, the second combustion event.

A first combustion event may be ignited by a first ignition source 164 upon actuation of the trigger 128. Upon ignition the piston is driven towards the second combustion chamber 154 until the maximum compression of the combustible material is achieved (i.e., the piston has achieved top dead center). Upon the driver blade 152 clearing the nose guide a fastener may be forwarded into the path of the driver blade. In an embodiment, a fastener is at least partially directed into the path of the driver by a pneumatically operated forwarding assembly discussed with respect to FIG. 7. In the present case "pneumatic" refers to combustion gasses rather than a source of compressed air. In the current example, first combustion event gasses are directed through appropriate porting to actuate the fastener forwarding assembly. In further embodiments, gasses may be trapped in a reservoir from a previous combustion sequence for utilization. In other embodiments, an electrically operated solenoid, or the like may be utilized for forwarding the fasteners or assisting in forwarding as will be discussed with respect to FIG. 7.

In the present instance, ignition of the second combustion event in the sleeve 112 (bounded by the piston head) and the second combustion chamber by the second ignition source 166 is triggered as a timed event by the printed circuit board relative to the first combustion event. In the present example, the ignition of the second combustion event is timed to correspond to the projected time at which the piston will substantially achieve top dead center. For example, it may be desirable to ignite the combustion event slightly before the piston reaches top dead center so that the bum may promulgate through the bum screen when top dead center is achieved. In further embodiments, the occurrence of the second combustion event may be triggered based on the position of the piston, the occurrence of a pre-selected pressure level, or the like. While the second combustion event is required to generate sufficient energy to drive the selected fastener to the selected depth, the first combustion event is of a smaller extent or generates less energy as only compression of the combustible material within the sleeve/second combustion chamber portion is required.

Referring to FIG. 5, upon the occurrence of the second combustion event the piston 136 is driven towards the nose guide of the combustion fastener 100 such that the fastener disposed in the path of the driver blade is driven into the workpiece. Upon the piston contacting the bumper the piston may be returned to a captured position for subsequent reuse. Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention.

Figure 7:
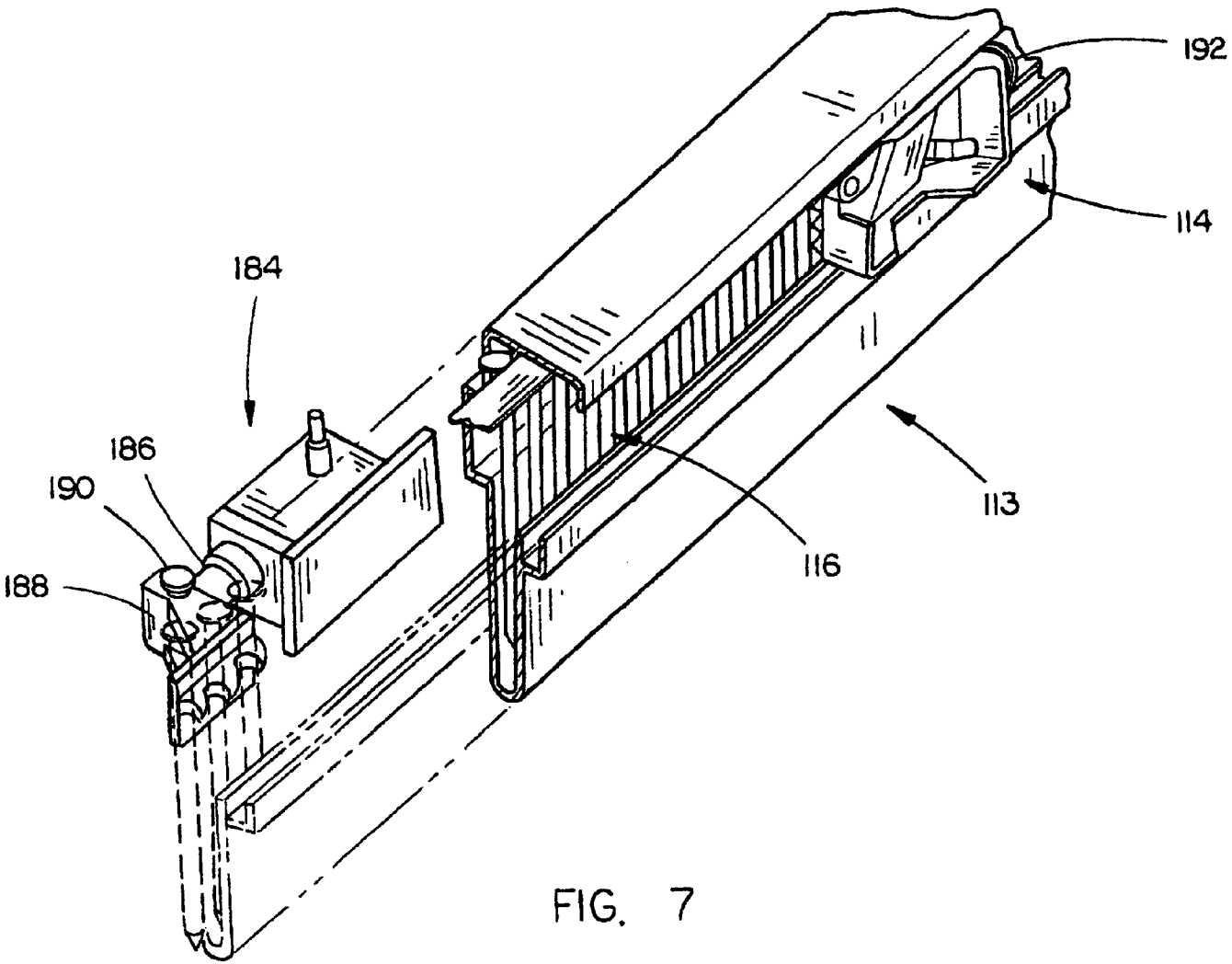
FIG. 7 is an isometric view illustrating magazine including a pneumatically operated nailfeed assembly and a spring biased pusher.

Referring to FIG. 7, an exemplary fastener forwarding device is described. Those of skill in the art will appreciate the principles of the present embodiment are generally applicable for utilization in directing other types of fasteners such as staples. A nailfeed assembly 184, in accordance with the present embodiment, may be utilized to forward nails to be secured towards the nose guide such that a nail is disposed in the path of travel of the driver blade. In the present embodiment, the nailfeed assembly 184 is constructed to operate utilizing gasses generated during the first combustion event to forward the nails or nail. A pneumatically operated cylinder assembly is fluidly coupled to the first chamber portion so a portion of the gasses generated in the first combustion event are utilized to drive (in the instant case) the stick of nails forward. A valve may be included for controlling the flow of gasses from the first chamber portion to the nailfeed. In a further example, the sleeve 112 may be utilized for the substantially similar purpose. A cleat 188 is configured to pivotally couple by a pivot pin 190 to the pneumatic cylinder 186 to allow nails to pass by the cleat 188. In the present example, a curved surface of the cleat directed away from the nose guide allows nails to pass by the cleat 188 prior to engagement by the cleat. In a further embodiment, a deformable tab having a generally wedge shape may be utilized. The nailfeed of the present invention may permit rapid forwarding of the nail to be secured such that the nail may be disposed in the path of the driver blade prior to the driver blade entering the nose guide. Those of skill in the art will appreciate a spring biased pusher assembly 114 may be utilized to forward the nails towards the nailfeed assembly. For instance, a coil spring 192 may be utilized for forwarding the nails so that they may be engaged by the nailfeed assembly.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A dual combustion event fastener device, comprising:

a combustion chamber;

a reciprocal piston disposed in the combustion chamber, the reciprocal piston generally separating the combustion chamber into a first chamber portion and a second chamber portion, the reciprocal piston including a driver blade, directed towards the first chamber portion, configured for contacting a fastener disposed in the driver blade's path of travel; and an ignition assembly configured to ignite a first combustion event in the first chamber portion and ignite a second combustion event in the second chamber portion, wherein the dual combustion event fastener device is configured such that the first combustion event is utilized to drive the piston such that combustible material within the second chamber portion is compressed.

2. The dual combustion event fastener device of claim 1, further comprising a fuel metering system for providing fuel to the first chamber portion and the second chamber portion.

3. The dual combustion event fastener device of claim 1, wherein the first combustion event generates less energy than the second combustion event.

4. The dual combustion event fastener device of claim 1, wherein the second combustion event is utilized to drive the fastener disposed in the driver blade's path of travel.

5. The dual combustion event fastener device of claim 1, further comprising a plate defining a plurality of through apertures, the plate being disposed within the second chamber portion between the point at which ignition is configured to occur and the piston, the plate being generally configured to cause turbulence in expanding gasses caused by the second combustion event.

6. The dual combustion event fastener device of claim 1, further comprising a fan disposed exterior to the combustion chamber, the fan being constructed so as to be in fluid communication with the first chamber portion and the second chamber portion.

7. The dual combustion event fastener device of claim 6, wherein the fan is configured to at least one of expel waste gasses or mix fuel and air in at least one of the first chamber portion or the second chamber portion subsequent to the driving of a fastener.

8. The dual combustion event fastener device of claim 6, further comprising an electronic fan control system for variably controlling operation of the fan based on at least one dual combustion event fastener device condition.

9. The dual combustion event fastener device of claim 8, wherein at least one dual combustion event fastener device condition is selected from the group consisting of device temperature and the occurrence of a combustion event.

10. The dual combustion event fastener device of claim 1, further comprising a fastener forwarding assembly in fluid communication with the first chamber portion, wherein the first chamber portion includes porting for providing at least a portion of the combustion gasses from the first combustion event for utilization in forwarding a fastener into the path of the driver blade.

11. The dual combustion event fastener device of claim 1, wherein dual combustion event fastener device is configured such that the driver blade is generally disposed in a nose of the dual combustion event fastener device, through which fasteners are expelled, prior to occurrence of the first combustion event.

12. The dual combustion event fastener device of claim 1, wherein the ignition assembly includes more than one ignition point in the second chamber portion.

13. The dual combustion event fastener device of claim 1, wherein at least one of the reciprocal piston and combustion chamber define an annular groove for catching a corresponding O-ring so as to position the reciprocal piston in a generally fixed position along the combustion chamber prior to the first combustion event.

14. The dual combustion event fastener device of claim 1, wherein the ignition assembly is configured to ignite the second combustion event, substantially, when the reciprocal piston is positioned so as to achieve substantially maximum compression of the combustible material within the second chamber portion.

15. The dual combustion event fastener device of claim 1, further comprising a fuel metering system in which fuel to be consumed in the first combustion event is not sprayed towards a point of ignition for the first combustion event.

16. The dual combustion event fastener device of claim 1, wherein at least a portion of the first chamber portion has a cross-sectional area which is greater than the maximum cross-sectional area of the reciprocal piston.

17. The dual combustion event fastener device of claim 1, further comprising a sleeve at least partially surrounding the combustion chamber, the sleeve being coupled to a contact safety, the outer sleeve being constructed for sliding covering of the combustion chamber including ports defined within the combustion chamber depending on movement of the contact safety.

18. A combustion fastener device, comprising:

a combustion chamber;

a nose guide axially aligned with the combustion chamber, the nose guide defining a channel for expelling fasteners;

a piston disposed in the combustion chamber, the piston generally separating the combustion chamber into a first chamber portion and a second chamber portion, the piston including a driver blade, directed towards the nose guide, configured for contacting a fastener disposed in the nose guide channel; and an ignition assembly configured to ignite a first combustion event in the first chamber portion and ignite a second combustion event in the second chamber portion, wherein the combustion fastener device is configured such that the first combustion event is utilized to drive the piston so combustible material, including fuel and air, within the second chamber portion is compressed to a pressure greater than the pressure of the combustible material within the second chamber prior to the first combustion event, the combustion fastener device being constructed so that the driver blade is at least partially disposed within the nose guide prior to the first combustion event.

19. The combustion fastener device of claim 18, further comprising a fuel metering system for providing fuel to the first chamber portion and the second chamber portion.

20. The combustion fastener device of claim 18, wherein the first combustion event generates less energy than the second combustion event.

21. The combustion fastener device of claim 18, wherein the second combustion event is utilized to drive the fastener disposed in the nose guide subsequent to the occurrence of the first combustion event.

22. The combustion fastener device of claim 18, further comprising a plate defining a plurality of through apertures, the plate being disposed within the second chamber portion between the point at which ignition is configured to occur and the piston, the plate being generally configured to cause turbulence in expanding gasses caused by the second combustion event.

23. The combustion fastener device of claim 18, further comprising a fan disposed exterior to the combustion chamber, the fan being constructed so as to be in fluid communication the first chamber portion and the second chamber portion.

24. The combustion fastener device of claim 23, wherein the fan is configured to at least one of expel waste gasses or mix fuel and air in at least one of the first chamber portion or the second chamber portion subsequent to the driver of a fastener.

25. The combustion fastener device of claim 23, further comprising an electronic fan control system for variably controlling operation of the fan based on at least one combustion fastener device condition.

26. The combustion fastener device of claim 25, wherein at least one combustion fastener device condition is selected from the group consisting of device temperature and the occurrence of a combustion event.

27. The combustion fastener device of claim 18, further comprising a fastener forwarding assembly in fluid communication with the first chamber portion, wherein the first chamber portion includes porting for providing at least a portion of the combustion gasses from the first combustion event for utilization in forwarding a fastener into the nose guide channel.

28. The combustion fastener device of claim 18, wherein the ignition assembly includes more than one ignition point in the second chamber portion.

29. The combustion fastener device of claim 18, wherein at least one of the piston and combustion chamber define an annular groove for catching a corresponding Oring so as to position the piston in a generally fixed position along the combustion chamber prior to the first combustion event.

30. The combustion fastener device of claim 18, wherein the ignition assembly is configured to ignite the second combustion event substantially when the piston has achieved the piston' maximum position away from the nose guide.

31. The combustion fastener device of claim 18, further comprising a fuel metering system in which fuel to be consumed in the first combustion event is not sprayed towards a point of ignition for the first combustion event.

32. The combustion fastener device of claim 18, wherein at least a portion of the first chamber portion has a cross-sectional area which is greater than the maximum cross-sectional area of the piston.

33. The combustion fastener device of claim 18, further comprising a sleeve at least partially surrounding the combustion chamber, the sleeve being coupled to a contact safety, the sleeve being constructed for sliding covering of the combustion chamber including ports defined within the combustion chamber, depending on movement of the contact safety.

34. A combustion fastener device, comprising:

a combustion chamber assembly; the combustion chamber assembly including:

a first combustion chamber portion defining an interior recess;

a second combustion chamber portion in alignment with the first combustion chamber portion, the second chamber portion defining an interior recess; and a sleeve configured to extend at least partially into the interior recess of the first combustion chamber portion and to extend at least partially into the interior recess of the second combustion chamber portion, the sleeve defining porting for controlling fluid communication between the first combustion chamber and the second combustion chamber, the sleeve being coupled to a contact safety to permit sliding adjustment depending on the position of the contact safety with respect to the first combustion chamber;

a nose guide axially aligned with the first combustion chamber portion, the nose guide defining a channel for expelling fasteners, the channel being in communication with the first combustion chamber portion;

a piston generally disposed to travel in the sliding sleeve, the piston generally separating the first and the second combustion chamber portions, the piston including a driver blade, directed towards the nose guide, configured for contacting a fastener disposed in the nose guide channel; and an ignition assembly configured to ignite a first combustion event in the first chamber portion and ignite a second combustion event in the sleeve on the side of the piston opposite the driver blade, wherein the combustion event fastener device is configured such that the first combustion event is utilized to drive the piston so combustible material, including fuel and air, within the sleeve on the side of the piston opposite the driver blade is compressed, to a pressure greater than the pressure of the combustible material within the sleeve on the side of the piston opposite the driver blade, prior to the first combustion event, during the second combustion event, the combustion fastener device being constructed so driver blade is at least partially disposed within the nose guide prior to the first combustion event.

35. The combustion fastener device of claim 34, further comprising a fuel metering system for providing fuel to the first chamber portion and the sleeve adjacent second chamber portion.

36. The combustion fastener device of claim 34, further comprising a plate defining a plurality of through apertures, the plate being disposed within the sleeve between the point at which ignition is configured to occur and the piston, the plate being generally configured to cause turbulence in expanding gasses caused by the second combustion event.

37. The combustion fastener device of claim 34, further comprising a fan disposed exterior to the combustion chamber, the fan being constructed so as to be capable of being in fluid communication the first chamber portion and the second chamber portion depending on the position of the sleeve.

38. The combustion fastener device of claim 37, further comprising an electronic fan control system for variably controlling operation of the fan based on at least one combustion fastener device condition.

39. The combustion fastener device of claim 34, further comprising a fastener forwarding assembly in fluid communication with the first chamber portion, wherein the first chamber portion includes porting for providing at least a portion of the combustion gasses from the first combustion event for utilization in forwarding a fastener into the nose guide channel.

40. The combustion fastener device of claim 34, wherein the ignition assembly includes more than one ignition point in the second chamber portion.

41. The combustion fastener device of claim 34, wherein at least one of the piston and combustion chamber define an annular groove for catching a corresponding Oring so as to position the piston in a generally fixed position along the combustion chamber prior to the first combustion event.

42. The combustion fastener device of claim 34, wherein the ignition assembly is configured to ignite the second combustion event substantially when the piston has achieved the piston' maximum position away from the nose guide.

43. The combustion fastener device of claim 34, wherein at least a portion of the first chamber portion has a cross-sectional area which is greater than the cross-sectional area of the sleeve.

* * * * *

UNITED STATES PATENT AND TRADEMARK OFFICE

CERTIFICATE OF CORRECTION

PATENT NO. : 8,002,160 B2
APPLICATION NO. : 11/215794
DATED : August 23, 2011
INVENTOR(S) : Larkin et al.

It is certified that error appears in the above-identified patent and that said Letters Patent is hereby corrected as shown below:

Column 12,
Lines 65-66, after "communication" insert -- with --.

Column 13,
Line 32, "piston'" should be -- piston's --.

Column 14,
Line 37, after "communication" insert -- with --.
Line 61, "piston'" should be -- piston's --.

Signed and Sealed this
Eleventh Day of October, 2011

David J. Kappos

David J. Kappos
*Director of the United States Patent and Trademark Office*